US006289621B1

(12) United States Patent
Vendetti et al.

(10) Patent No.: US 6,289,621 B1
(45) Date of Patent: Sep. 18, 2001

(54) BAYONET LUG CLAMP

(75) Inventors: Vincent J. Vendetti, Fredericksburg; Michael M. Canaday, King George, both of VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/427,042

(22) Filed: Oct. 20, 1999

(51) Int. Cl.[7] ..... F41C 27/00
(52) U.S. Cl. ..... 42/86; 42/106
(58) Field of Search ..... 42/86, 53, 64, 42/90, 85, 100, 106

(56) References Cited

U.S. PATENT DOCUMENTS 3,750,318 * 8/1973 Burris .
3,955,299 5/1976 Bullis ..... 42/1 R
4,494,328 * 1/1985 Stevens .
4,539,769 * 9/1985 Stevens et al. .
4,571,870 * 2/1986 Heideman et al. .
4,691,442 9/1987 Center ..... 33/253
4,893,426 1/1990 Bixler ..... 42/75.01
5,092,071 * 3/1992 Moore .
5,198,600 * 3/1993 E'Nama .
5,433,133 7/1995 La France ..... 89/14.2
5,546,691 * 8/1996 Allison .
5,559,302 * 9/1996 Latka .
5,685,102 * 11/1997 Latka .
5,918,374 * 7/1999 Campbell .
6,115,952 * 9/2000 Rigler .
6,134,823 * 10/2000 Griffin .

* cited by examiner

*Primary Examiner*—Charles T. Jordan
*Assistant Examiner*—Troy Chambers
(74) *Attorney, Agent, or Firm*—James B. Bechtel, Esq.; Peter J. Van Bergen, Esq.

(57) ABSTRACT

A bayonet lug clamp has a housing opened on one end thereof for slidingly engaging the bayonet lug. A plate is mounted in the housing and opposes the bayonet lug as the housing is slid thereon. A screw passes through the housing to threadably engage the plate. Turning of the screw draws the plate against the bayonet lug.

13 Claims, 2 Drawing Sheets

FIG.1A
PRIOR ART
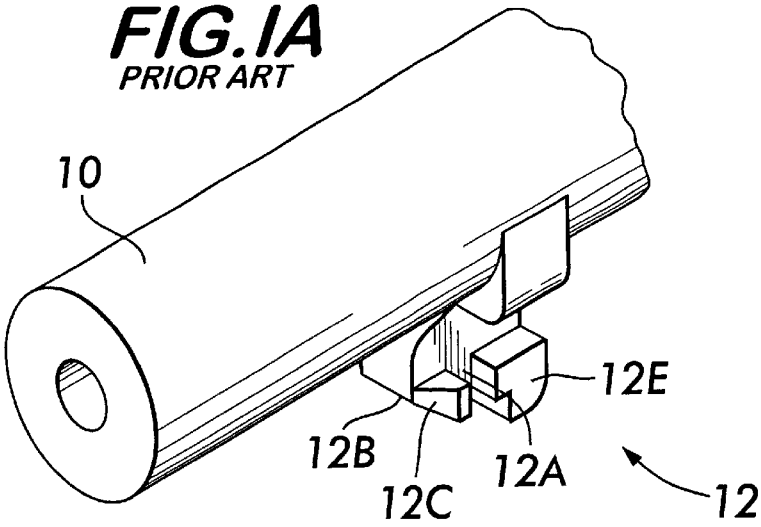
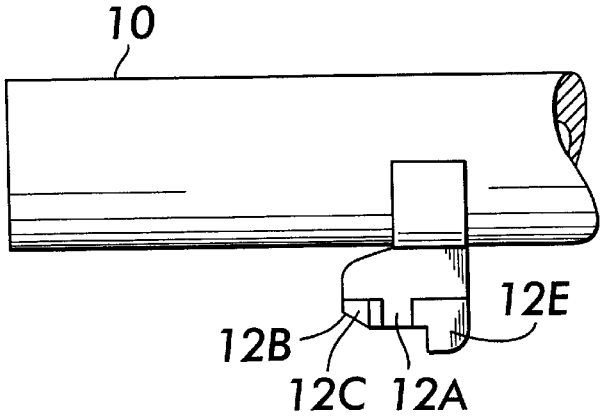
FIG.1B
PRIOR ART
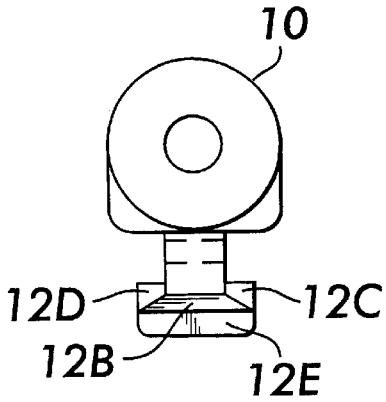
FIG.1C
PRIOR ART
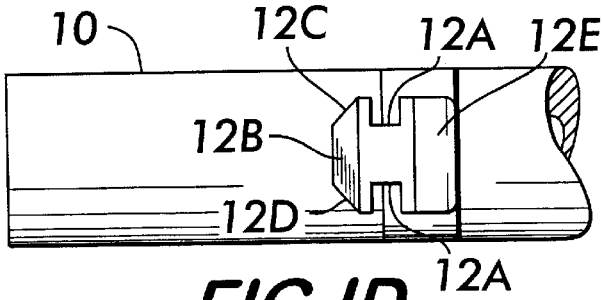
FIG.1D
PRIOR ART

BAYONET LUG CLAMP

CROSS-REFERENCE TO RELATED PATENT APPLICATIONS

This patent application is co-pending with one related patent application entitled "BAYONET LUG AND MUZZLE MOUNTED ACCESSORY RAIL" (Navy Case No. 82029) and assigned to the same assignee as this patent application.

ORIGIN OF THE INVENTION

The intention described herein was made in the performance of official duties by an employee of the Department of the Navy and may be manufactured, used, licensed by or for the Government for any governmental purpose without payment of any royalties thereon.

FIELD OF THE INVENTION

The invention relates generally to the mounting of accessories on a rifle, and more particularly to a clamp that supports an accessory and rigidly clamps onto the bayonet lug of a rifle.

BACKGROUND OF THE INVENTION

Military rifles such as the M-16 are used in a wide variety of operational situations. Each rifle is typically equipped with a lug near its muzzle end for the mounting of a bayonet. However, some situations may require the use of different rifle accessories such as a flashlight, a laser sighting device, a scope, etc. Optimal positioning of many of these accessories is near the muzzle end of the rifle. Accordingly, attachment of such accessories using the rifle's bayonet lug is desirable. Attachment could be accomplished by coupling the accessory directly to the bayonet lug via a coupling or clamp. Alternatively, the accessory could be mounted to a universal mounting rail that is clamped onto the bayonet lug. For example, there is an accessory mounting rail (manufactured in accordance with Military Standard 1913) designed to serve as the attachment point for a number of different accessory devices.

The accessory or accessory mounting rail should be easily and quickly attachable to a rifle without the need for any tools or any modification of the rifle. Further, once mounted, the accessory or accessory mounting rail should be secure and maintain its position after the rifle is fired.

SUMMARY OF THE INVENTION

Accordingly, it is an object of the present invention to provide a clamp that securely attaches to the bayonet lug of a rifle.

Another object of the present invention is to provide a clamp that can be attached to a rifle's bayonet lug without the use of any tools or modification of the rifle while supporting an accessory or accessory mounting rail.

Still another object of the present invention to provide a clamp that attaches to a rifle's bayonet lug and maintains its position after the rifle is fired.

Other objects and advantages of the present invention will become more obvious hereinafter in the specification and drawings.

In accordance with the present invention, a bayonet lug clamp is provided for use with a rifle having a bayonet lug. A housing is opened on one end thereof for slidingly engaging the bayonet lug. A plate is mounted in the housing and opposes the bayonet lug as the housing is slid thereon. A screw passes through the housing to threadably engage the plate. Turning of the screw draws the plate against the bayonet lug. The plate can have protrusions or teeth to positively engage the bayonet lug as the plate is drawn thereagainst.

BRIEF DESCRIPTION OF THE DRAWINGS

FIG. 1A is a perspective view of the muzzle end of an M-16 rifle to include the rifle's bayonet lug;

FIG. 1B is a side view of the muzzle end and bayonet lug;

FIG. 1C is a bottom view of the muzzle end and bayonet lug;

FIG. 1D is a front view of the muzzle end and bayonet lug;

DETAILED DESCRIPTION OF THE INVENTION

Figure 2:
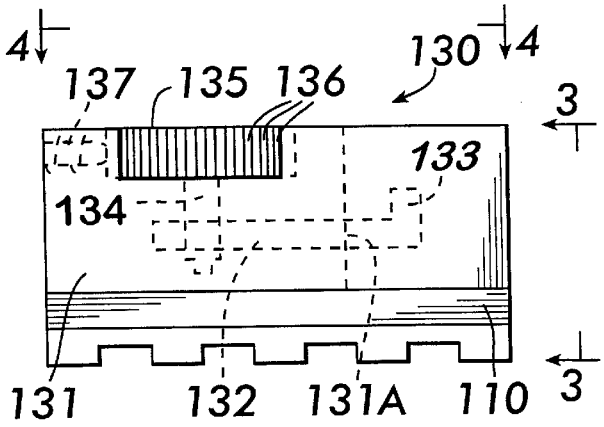
FIG. 2 is a side view of the bayonet lug clamp according to an embodiment of the present invention.

Referring now to the drawings, and more particularly to FIGS. 1A–1D, various views are shown of the muzzle end 10 and a rigid bayonet lug 12 of an M-16 rifle. Identical reference numbers will be used for the same elements in the various views. owing to its widespread use in a variety of military applications, the M-16 rifle will be described by way of example as the point of attachment for an accessory or an accessory mounting rail. However, as will be readily apparent to one of ordinary skill in the art, the present invention can be adapted to work with any firearm having a bayonet lug located near its muzzle.

Muzzle end 10 is cylindrical as would be the case for most firearms. Bayonet lug 12 is mounted or attached to the underside of the rifle and rearward of muzzle end 10. Along its length, bayonet lug 12 is substantially an inverted T-shape except for opposing slots 12A formed on either side thereof in a central portion of bayonet lug 12. Forward of slots 12A, the lower portion of the T-shape of bayonet lug 12 is swept angularly rearward from the front 12B and at the left and right sides 12C and 12D, respectively. Rearward of slots 12A, the inverted T-shape is continued at 12E.

Figure 3:
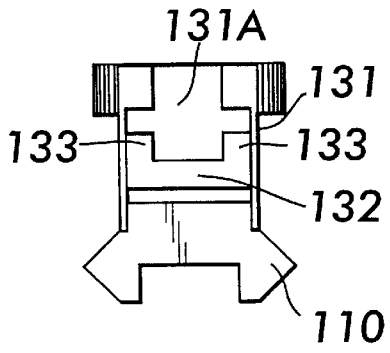
FIG. 3 is an aft end view taken along line 3—3 in FIG. 2.
Figure 4:
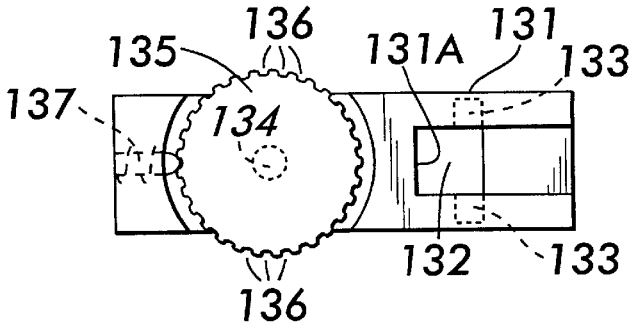
FIG. 4 is a view of the bayonet clamp taken along line 4—4 in FIG. 2.
Figure 5:
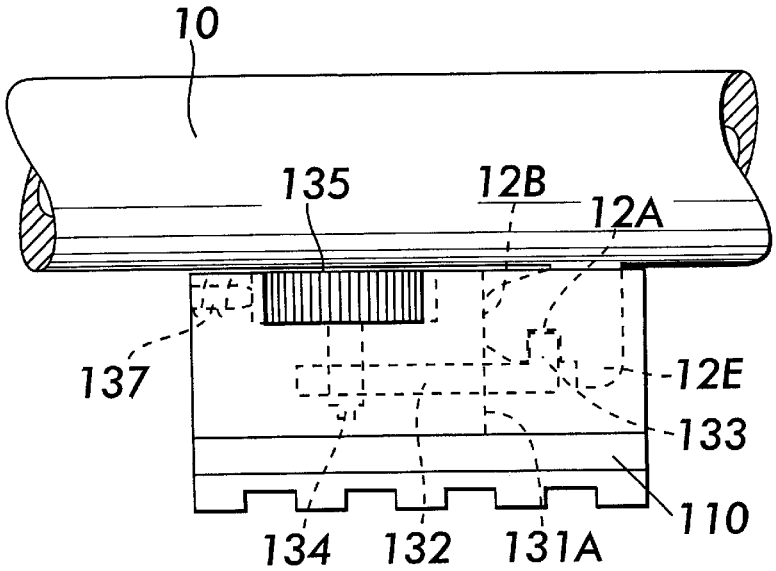
FIG. 5 is a side view of the bayonet lug clamp coupled to the bayonet lug of an M-16 rifle.

The bayonet lug clamp of the present invention will now be explained with the aid of FIGS. 2–5 where FIGS. 2–4 depict various views of the bayonet lug clamp in isolation and FIG. 5 depicts the bayonet lug clamp attached to bayonet lug 12 of an M-16 rifle. Once again, identical reference numbers will be used for the same elements in the various views.

By way of example, the bayonet lug clamp of the present invention will be shown and described for its use in coupling an accessory mounting rail to an M-16's bayonet lug. Specifically, FIG. 2 illustrates an accessory mounting rail 110 coupled to a bayonet lug clamp 130. However, it is to be understood that bayonet lug clamp 130 could also be coupled to a particular accessory (not shown) that is to be mounted to the bayonet lug.

Accessory mounting rail 110 can be any rail on which rifle or other mission-specific accessories (e.g., light(s), laser sighting device, scope(s), bayonet, etc.) are easily mounted. For example, accessory mounting rail 110 can be made in accordance with Military Standard 1913 (MIL-STD-1913) which defines the dimensions and specifications for the most widely used accessory mounting rail. Details related to accessory mounting rail 110 are not a limitation of the present invention and, therefore, will not be described further herein.

Mounted to (or integrated with) accessory mounting rail 110 (or directly to a particular accessory) is bayonet clamp 130. More specifically, bayonet clamp 130 has a rigid housing 131 that is opened on its aft end and shaped like a split, inverted "U" (FIG. 3) so that it can slide fully on bayonet lug 12 as best seen in FIG. 5. Housing 131 is free to slide along bayonet lug 12 until an interior wall 131A thereof abuts front 12B of bayonet lug 12. Mounted within housing 131 is a rigid clamping plate 132 positioned such that a portion of plate 132 is adjacent bayonet lug 12 when housing 131 is slid onto bayonet lug 12. Specifically, teeth 133 extending from plate 132 are aligned with slots 12A when interior wall 131A abuts front 12B. In this way, teeth 133 are positioned to engage slots 12A of bayonet lug 12 when plate 132 is drawn towards bayonet lug 12.

Controlling the position of plate 132 is a positioning screw 134 hiving a thumb-wheel or knob 135. Screw 134 passes through housing 131 and knob 135 extends from either side of housing 131 to allow rotation thereof from either side of housing 131. To lock screw 134 in its selected position, a detent can be provided to cooperate therewith. In the illustrated embodiment, the detent cooperates with knob 135 which resides and rotates in housing 131. Specifically, knob 135 is provided with evenly-distributed indentations 136 about its periphery. A spring-pin 137 installed in housing 131 is biased to spring into one of indentations 136 as knob 135 is rotated. Spring-pin 137 can be rounded at its tip to facilitate rotation of knob 135.

In operation, housing 131 is slid into engagement with bayonet lug 12 until interior wall 131A abuts front 12B of bayonet lug 12. Knob 135 is then rotated until plate 132 is snugly seated against bayonet lug 12 with teeth 133 engaging slots 12A. The detent provided by spring-pin 137 restrains knob 135 from unwanted movement and, therefore, keeps bayonet lug clamp 130 securely in place before and after rifle firing.

The advantages of the present invention are numerous. The bayonet lug clamp attaches quickly and easily to the bayonet lug and muzzle of the M-16 rifle without any requiring any modification of the rifle. The system can be installed and locked in place using only one's left or right hand. Attachment at the bayonet lug provides an accessible and optimal mounting location for a variety of rifle accessories. The bayonet lug clamp is locked in its engaged position so that the accessory or accessory mounting rail will not have its position affected by the rifle's firing.

Although the invention has been described relative to a specific embodiment thereof, there are numerous variations and modifications that will be readily apparent to those skilled in the art in light of the above teachings. For example, plate 132 and the shape/position of teeth 133 can be adjusted to work with any type of bayonet lug. The detent could cooperate with indentations provided on the bottom of knob 135 or with indentations provided directly on screw 134. It is therefore to be understood that, within the scope of the appended claims, the invention may be practiced other than as specifically described.

What is claimed as new and desired to be secured by Letters Patent of the United States is:

1. A device for use with a rifle having a bayonet lug, said device comprising:

an accessory mounting rail;

a housing attached to said accessory mounting rail, said housing opened on one end thereof for slidingly engaging the bayonet lug;

a plate mounted in said housing and opposing the bayonet lug as said housing is slid thereon; and a screw passing through said housing and threadably engaging said plate for drawing said plate against the bayonet lug.

2. A device as in claim 1 wherein said accessory mounting rail is made in accordance with Military Standard 1913.

3. A device as in claim 2 wherein said plate includes a U-shaped portion for positively engaging the bayonet lug as said plate is drawn thereagainst.

4. A device as in claim 1 further comprising a detent cooperating between said housing and said screw.

5. A bayonet lug clamp for a rifle having a bayonet lug, comprising:

a housing opened on one end thereof for slidingly engaging the bayonet lug;

a plate mounted in said housing and opposing the bayonet lug as said housing is slid thereon; and a screw passing through said housing and threadably engaging said plate for drawing said plate against the bayonet lug.

6. A bayonet lug clamp as in claim 5 wherein said plate includes a U-shaped portion for positively engaging the bayonet lug as said plate is drawn thereagainst.

7. A bayonet lug clamp as in claim 5 wherein said screw has a knob extending beyond either side of said housing, said system further comprising a detent cooperating between said housing and said knob.

8. A bayonet lug clamp as in claim 7 wherein said knob has a plurality of indentations formed in an outer periphery thereof, and wherein said detent is mounted in said housing and biased to engage one of said plurality of indentations.

9. A bayonet lug clamp as in claim 8 wherein said plurality of indentations are evenly distributed about said outer periphery.

10. A bayonet lug clamp for use with a rifle having a T-shaped bayonet lug having slots formed in a central portion thereof, said bayonet lug clamp comprising:

a housing having an end portion configured to slidingly engage the T-shaped portion of the bayonet lug;

a plate mounted in said housing, said plate having teeth protruding therefrom, said teeth aligned with the slots in the bayonet lug when said housing is slid thereon; and a screw passing through said housing and threadably engaging said plate for drawing said teeth into engagement with the slots of the bayonet lug.

11. A bayonet lug clamp as in claim 10 wherein said screw terminates in a knob extending beyond either side of said housing, said knob having a plurality of indentations formed in an outer periphery thereof, and said system further comprising a detent mounted in said housing and biased to engage one of said plurality of indentations.

12. A bayonet lug clamp as in claim 11 wherein said plurality of indentations are evenly distributed about said outer periphery.

13. A bayonet lug clamp as in claim 10 wherein said housing includes a stop therein for abutting the bayonet lug as said housing is slid thereon, wherein said teeth are aligned with the slots in the bayonet lug.

* * * * *